US008292297B2

(12) United States Patent
Murakami

(10) Patent No.: US 8,292,297 B2
(45) Date of Patent: Oct. 23, 2012

(54) SHEET SEPARATION MECHANISM AND IMAGE FORMING APPARATUS WITH FIRST AND SECOND BIASING MEMBERS

(75) Inventor: Susumu Murakami, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/174,966

(22) Filed: Jul. 1, 2011

(65) Prior Publication Data

US 2012/0001379 A1 Jan. 5, 2012

(30) Foreign Application Priority Data

Jul. 5, 2010 (JP) ..... 2010-152620

(51) Int. Cl.
*B65H 29/54* (2006.01)

(52) U.S. Cl. ..... 271/311; 271/900; 399/323; 399/398

(58) Field of Classification Search ..... 271/311, 271/307, 900; 399/323, 398
See application file for complete search history.

(56) References Cited

U.S. PATENT DOCUMENTS 4,408,757 A * 10/1983 Yarm ..... 271/311
6,029,039 A * 2/2000 Aslam et al. ..... 271/307
2011/0188905 A1* 8/2011 Shinkawa et al. ..... 399/323

FOREIGN PATENT DOCUMENTS

| | | | |
|---|---|---|---|
| JP | 61-200564 A | | 9/1986 |
| JP | 61200564 A | * | 9/1986 |
| JP | 63-217387 A | | 9/1988 |
| JP | 63217387 A | * | 9/1988 |
| JP | 4-128778 A | | 4/1992 |
| JP | 04128778 A | * | 4/1992 |
| JP | 5-307336 A | | 11/1993 |
| JP | 05307336 A | * | 11/1993 |
| JP | 10-177305 A | | 6/1998 |

* cited by examiner

*Primary Examiner* — Gerald McClain
(74) *Attorney, Agent, or Firm* — Birch, Stewart, Kolasch & Birch,LLP

(57) ABSTRACT

A sheet separation mechanism includes a separation claw holder, a separation claw, a first coil spring and a second coil spring. The separation claw holder can be provided at a predetermined place in the image forming apparatus. The separation claw includes a separation claw base pivotally supported by the separation claw holder and a separation claw front-end pivotally supported by the separation claw base. The first coil spring is configured to apply a force to rotate the separation claw base toward an intermediate transfer belt. The second coil spring is configured to apply a force to rotate the separation claw front-end toward the intermediate transfer belt.

2 Claims, 4 Drawing Sheets

SHEET SEPARATION MECHANISM AND IMAGE FORMING APPARATUS WITH FIRST AND SECOND BIASING MEMBERS

CROSS REFERENCE

This Nonprovisional application claims priority under 35 U.S.C. §119(a) on Patent Application No. 2010-152620 filed in Japan on Jul. 5, 2010 the entire contents of which are hereby incorporated by reference.

BACKGROUND OF THE INVENTION

The present invention relates to a sheet separation mechanism disposed so as to be opposed to a circumferential face of a rotating body disposed along a sheet conveyance path in an image forming apparatus and an image forming apparatus provided with the sheet separation mechanism. In image forming apparatuses, rotating bodies such as a photoreceptor drum and an intermediate transfer belt disposed along a sheet conveyance path are provided with a separation claw in the vicinity of thereof so as not to entangle a sheet therein. To appropriately prevent such entangling of a sheet in a rotating body, a separation claw has to be brought into contact with a circumferential face of the rotating body. On the other hand, when a separation claw with a sharp tip is pressed strongly against a rotating body, the rotating body may be damaged by the separation claw.

To avoid such a trouble, some conventional techniques provide a separation claw attached at a support position so that, upon being pressed by a paper jam, a tip of the separation claw moves away from a rotating body (for instance, see JP H04-128778 A, called Patent Document 1).

Although this conventional technique can prevent a rotating body from being damaged by the separation claw that is pressed by a paper jam against the rotating body, it has a problem of impairing the original function of the separation claw. This is because, in the technique according to Patent Document 1, since the tip of the separation claw moves away from the circumferential face of the rotating body during paper jamming, the separation claw cannot perform the original function of preventing the rotating body from entangling a sheet. As a result, when multiple sheets are fed, paper jam may occur in the rotating body.

It is an object of the present invention to provide a sheet separation mechanism and an image forming apparatus capable of appropriately preventing a circumferential face of a rotating body from being damaged by a tip of a separation claw without impairing the original function of the separation claw.

SUMMARY OF THE INVENTION

A sheet separation mechanism according to the present invention is disposed so as to be opposed to a circumferential face of a rotating body disposed along a sheet conveyance path in an image forming apparatus. Examples of the rotating body include a photoreceptor drum, an intermediate transfer belt unit and a fixing roller.

The sheet separation mechanism includes a separation claw holder, a separation claw, first biasing member and second biasing member. The separation claw holder can be provided at a predetermined place in the image forming apparatus. For instance, the separation claw holder may be attached to an internal frame in the image forming apparatus via a fixture such as a screw. The separation claw includes a separation claw base pivotally supported by the separation claw holder and a separation claw front-end pivotally supported by the separation claw base.

The first biasing member is disposed between the separation claw holder and the separation claw base. This first biasing member is configured to apply a force to rotate the separation claw base toward the rotating body. The second biasing member is disposed between the separation claw base and the separation claw front-end. This second biasing member is configured to apply a force to rotate the separation claw front-end toward the rotating body. Typical examples of the first biasing member and the second biasing member include a coil spring, but not limited to this, which may be a flat spring or a compression spring.

In this configuration, the separation claw itself is configured to bend between the separation claw base and the separation claw front-end. Therefore, when a sheet causing a conveyance jam applies a force to press the separation claw, the separation claw bends, thus absorbing the force from the sheet. As a result, when a sheet causing a conveyance jam presses the separation claw, a trouble such as the circumferential face of the rotating body damaged by the sharp tip of the separation claw front-end engaged therein can be prevented appropriately.

Even when the separation claw bends, the tip of the separation claw is kept to come into contact with the rotating body, and therefore a trouble of the rotating body entangling a sheet during multi-sheet feeding can be appropriately prevented without impairing the original function of the separation claw.

Preferably, in this configuration, a biasing force of the second biasing member is larger than a biasing force of the first biasing member. This configuration is preferable because the tip of the separation claw can easily and more appropriately come into contact with the circumferential face of the rotating body, and even when the separation claw bends by a force applied from a sheet causing a conveyance jam, the separation claw can easily return to the original state after removal of the sheet.

The present invention can prevent the circumferential face of a rotating body from being damaged by the tip end of a separation claw appropriately without impairing the original function of the separation claw.

DETAILED DESCRIPTION OF THE INVENTION

Figure 1:
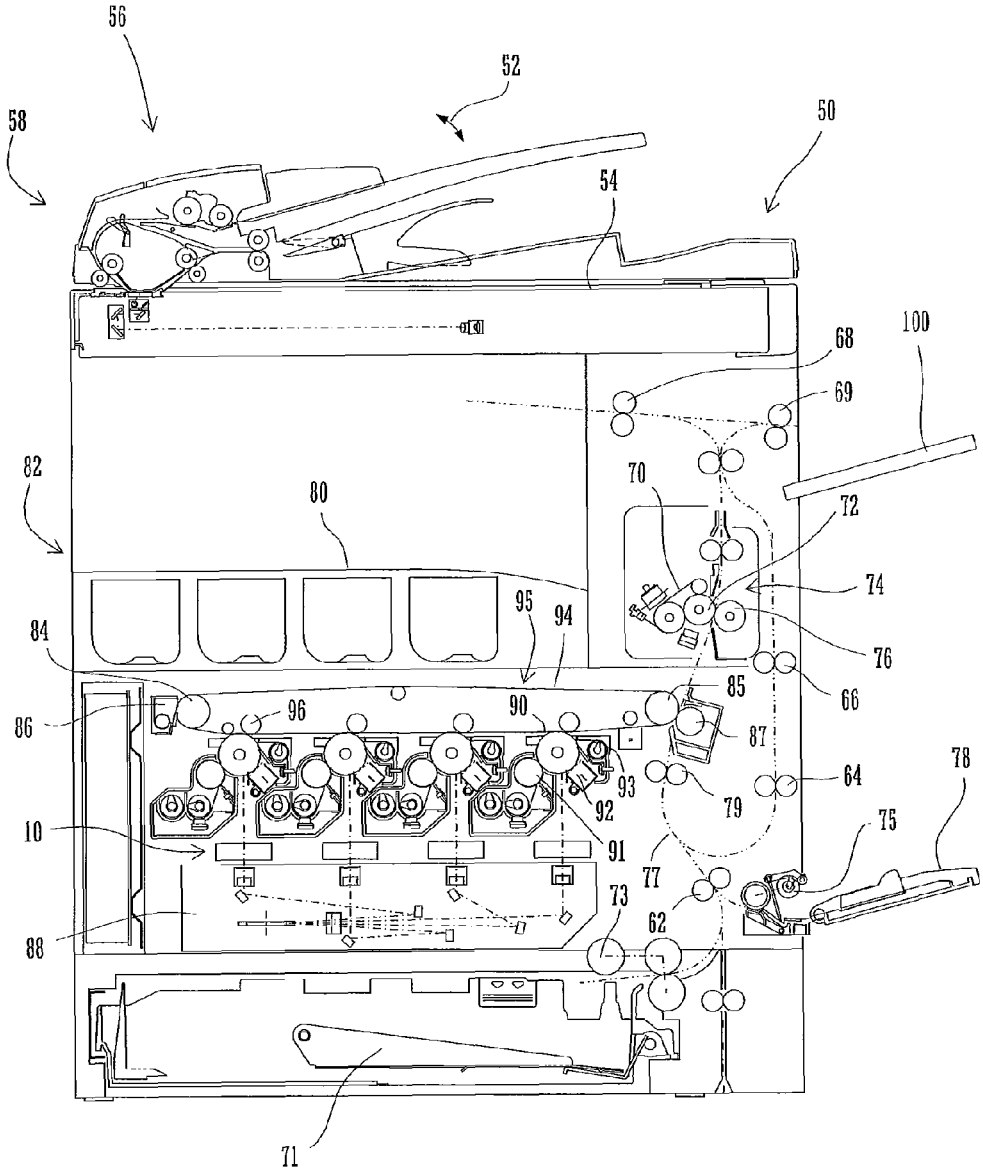
FIG. 1 schematically illustrates an image forming apparatus according to one embodiment of the present invention.

FIG. 1 schematically illustrates an image forming apparatus 50 according to one embodiment of the present invention. The image forming apparatus 50 forms multicolored or single-colored images on a predetermined sheet (recording sheet) in accordance with image data externally transmitted, and includes an image forming section 82 and a document reader 58.

The image forming section 82 includes four image formation stations each forming a color image in black (K), cyan (C), magenta (M) or yellow (Y). Each image formation station includes a development unit 91, a photoreceptor drum 90, a cleaner unit 93 and a charger 92.

The image forming section 82 further includes an optical scanning device 88, an intermediate transfer belt unit 95, a fixing unit 74, a paper feeding cassette 71, a first copy receiving tray 80, a second copy receiving tray 100, a plurality of flappers (not illustrated) to change a conveyance direction of a sheet and the like.

Above the image forming section 82 is provided a document platen 54 made of transparent glass on which a document is placed, and above the document platen 54 is installed an automatic document processor 56. The automatic document processor 56 automatically conveys a document onto the document platen 54. The automatic document processor 56 is configured rotatably to leave the document platen 54 open so that a document can be manually placed on the document platen 54.

The charger 92 is means to uniformly charge the surface of the photoreceptor drum 90 at a predetermined electrical potential, which may be a contact type charger such as a roller or a brush instead of a non-contact type charger as illustrated in FIG. 1. The optical scanning device 88 is configured to form an electrostatic latent image on the surface of each photoreceptor drum 90 in accordance with image data input.

Each development unit 91 makes the electrostatic latent image formed on the corresponding photoreceptor drum 90 visible with toner in one of the four colors. Each cleaner unit 93 removes and collects toner remaining on the surface of the corresponding photoreceptor drum 90 after a transferring step.

The intermediate transfer belt unit 95 disposed above the photoreceptor drums 90 includes an intermediate transfer belt 94, an intermediate transfer belt driving roller 85, an intermediate transfer belt idle roller 84, four intermediate transfer rollers 96, and an intermediate transfer belt cleaning unit 86.

The intermediate transfer belt driving roller 85, the intermediate transfer belt idle roller 84 and the intermediate transfer rollers 96 are configured to stretch the intermediate transfer belt 94 therebetween. Each intermediate transfer roller 96 is configured to transfer a toner image on the corresponding photoreceptor drum 90 onto the intermediate transfer belt 94.

The intermediate transfer belt 94 is provided to come into contact with each photoreceptor drum 90, and has a function to let a toner image in each color formed on the photoreceptor drum 90 to be transferred and sequentially overlaid thereon, so that a color toner image (multicolored toner image) is formed on the intermediate transfer belt 94. The intermediate transfer belt 94 is formed as an endless belt using film of 100 μm to 150 μm in thickness, for example.

When toner images are transferred from the photoreceptor drums 90 to the intermediate transfer belt 94, a transfer bias of a high voltage (high voltage with reversed polarity (+) of the polarity (−) of charged toner) is applied to the intermediate transfer rollers 96 for transferring of the toner images. Each of the intermediate transfer rollers 96 is a roller including a metal (e.g., stainless steel) shaft of 8 to 10 mm in diameter as a base that is surrounded by a conductive elastic material (e.g., EPDM or urethane foam). This conductive elastic material enables the uniform application of a high voltage to the intermediate transfer belt 94. The present embodiment uses the transfer electrodes in a roller shape, but not limited to, and a brush type transfer electrode may be used for example.

As stated above, the electrostatic image is made visible on each photoreceptor drum 90 in the corresponding color, and is overlaid on the intermediate transfer belt 94. As the intermediate transfer belt 94 rotates, the thus overlaid image information is transferred onto a sheet by a secondary transfer roller 87 described below that is disposed at a contact position of the sheet and the intermediate transfer belt 94.

At this time, the intermediate transfer belt 94 and the secondary transfer roller 87 are brought into contact with each other by pressurizing with a predetermined nip, while a voltage (high voltage with reversed polarity (+) of the polarity (−) of charged toner) is applied to the secondary transfer roller 87 for transferring of the toner onto a sheet. In order to allow the secondary transfer roller 87 to give the above-stated nip steadily, any one of the secondary transfer roller 87 and the intermediate transfer belt driving roller 85 may be made of a hard material (e.g., metal), and the other may be an elastic roller made of a soft material (e.g., elastic rubber roller or foaming resin roller).

As stated above, toner is adhered to the intermediate transfer belt 94 in contact with the photoreceptor drums 90 or toner remains on the intermediate transfer belt 94 without being transferred to a sheet by the secondary transfer roller 87, and such toner causes the mixture of colors of toner at a following step. In order to avoid this, the intermediate transfer belt cleaning unit 86 is provided to remove and collect such toner. The intermediate transfer belt cleaning unit 86 includes a cleaning blade, for example, as cleaning member coming into contact with the intermediate transfer belt 94. At a portion in contact with the cleaning blade, the intermediate transfer belt 94 is supported by the intermediate transfer belt idle roller 84 from the opposite side.

The paper feeding cassette 71 is a tray for storing sheets (recording sheets) used for image formation, and is disposed below the optical scanning device 88 of the image forming section 82. The sheets used for image formation may be placed on a manual paper feeding cassette 78 as well.

The first copy receiving tray 80 is disposed above the image forming section 82, and is configured so that sheets subjected to printing are piled up while letting the printed side face downward. On the other hand, the second copy receiving tray 100 is disposed outside the casing of the image forming apparatus 50, and is configured so that sheets subjected to printing are piled up while letting the printed side face upward.

The image forming section 82 is provided with a sheet conveyance path 77 to send a sheet from the paper feeding cassette 71 or the manual paper feeding cassette 78 to the first copy receiving tray 80 or the second copy receiving tray 100 via the secondary transfer roller 87 and the fixing unit 74. In the vicinity of the sheet conveyance path 77 from the paper feeding cassette 71 and the manual paper feeding cassette 78 to the first copy receiving tray 80 and the second copy receiving tray 100 are disposed pickup rollers 73 and 75, a plurality of conveyance rollers 62, 64, 66 and 68, paper stop rollers 79, the secondary transfer roller 87 and the fixing unit 74, for example.

The conveyance rollers 62, 64, 66 and 68 are small rollers to promote and assist the conveyance of a sheet, and a plurality of these rollers are provided along the sheet conveyance path 77. The pickup roller 73 is provided in the vicinity of an end of the paper feeding cassette 71 so as to pick up sheets one by one from the paper feeding cassette 71 and supply the sheet to the sheet conveyance path 77. Similarly, the pickup roller 75 is provided in the vicinity of an end of the manual paper feeding cassette 78 so as to pick up sheets one by one from the manual paper feeding cassette 78 and supply the sheet to the sheet conveyance path 77.

The paper stop rollers 79 hold a sheet being conveyed along the sheet conveyance path 77 once. Then, the paper stop rollers 79 function to convey the sheet to the secondary transfer roller 87 at timing when a front end of a toner image on the photoreceptor drum 90 and a front end of the sheet are aligned.

The fixing unit 74 includes a heat roller 72 and a pressure roller 76, and the heat roller 72 and the pressure roller 76 rotate while sandwiching a sheet therebetween. The heat roller 72 is set at a predetermined fixing temperature by a controller on the basis of a signal from a temperature detector not illustrated. The heat roller 72 as well as the pressure roller 76 have a function to heat and pressurize toner with respect to a sheet to melt, mix and pressurize a multicolored toner image transferred on the sheet for heat fixing. An external heating belt 70 is further provided to heat the heat roller 72 externally.

The following describes the sheet conveyance path in detail. As stated above, the image forming apparatus is provided with the paper feeding cassette 71 for storing sheets beforehand and the manual paper feeding cassette 78. In order to feed a sheet from these paper feeding cassettes 71 and 78, the pickup rollers 73 and 75 are provided, respectively, so as to guide sheets one by one to the conveyance path 77.

A sheet is conveyed from the paper feeding cassette 71 or the manual paper feeding cassette 78 to the paper stop rollers 79 by the conveyance rollers 62 in the sheet conveyance path 77. Then, the sheet is conveyed to the secondary transfer roller 87 at timing when a front end of the sheet is aligned with a front end of image information on the intermediate transfer belt 94, and the image information is written on the sheet. Thereafter, the sheet passes through the fixing unit 74 so that unfixed toner is melt and fixed for adhesion to the sheet by heat, and is discharged via the conveyance rollers 68 provided downstream to the first copy receiving tray 80 or the second copy receiving tray 100.

The above-stated conveyance path is for single-sided printing. On the other hand, in the case of double-sided printing, a sheet subjected to single-sided printing as stated above and passing through the fixing unit 74 is held at its rear end by the finally disposed conveyance rollers 68. Thereafter, the conveyance rollers 68 rotate reversely and flappers (not illustrated) are changed in their positions so as to guide the paper to a returning conveyance path along which the conveyance rollers 66 and 64 are disposed. The sheet passes through the returning conveyance path and the paper stop rollers 79 to the contact position with the intermediate transfer belt 94, where printing is performed on the rear face of the sheet. The sheet is then discharged to the first copy receiving tray 80.

Figure 2A:
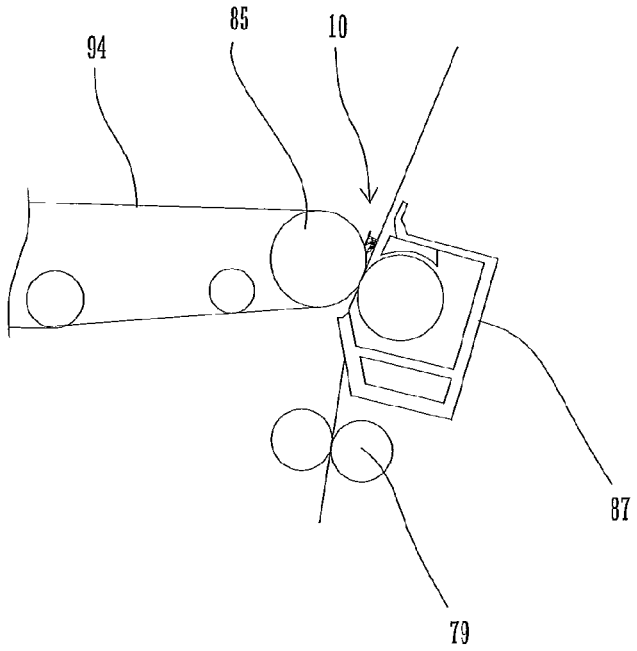
FIG. 2A is a side view illustrating the arrangement of a sheet separation mechanism according to one embodiment of the present invention.
Figure 2B:
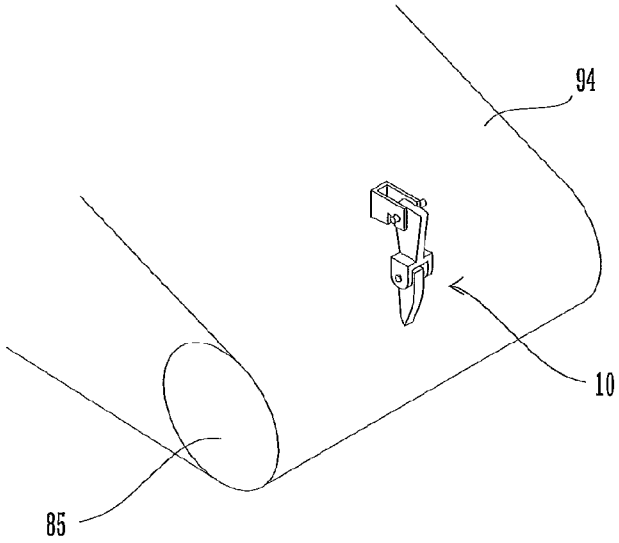
FIG. 2B is a perspective view illustrating the arrangement of the sheet separation mechanism.

As illustrated in FIG. 2A and FIG. 2B, in the thus stated configuration, a sheet separation mechanism 10 is provided so as to come into contact with a circumferential face of the intermediate transfer belt 94 at a part stretched by the intermediate transfer belt driving roller 85.

Figure 3A:
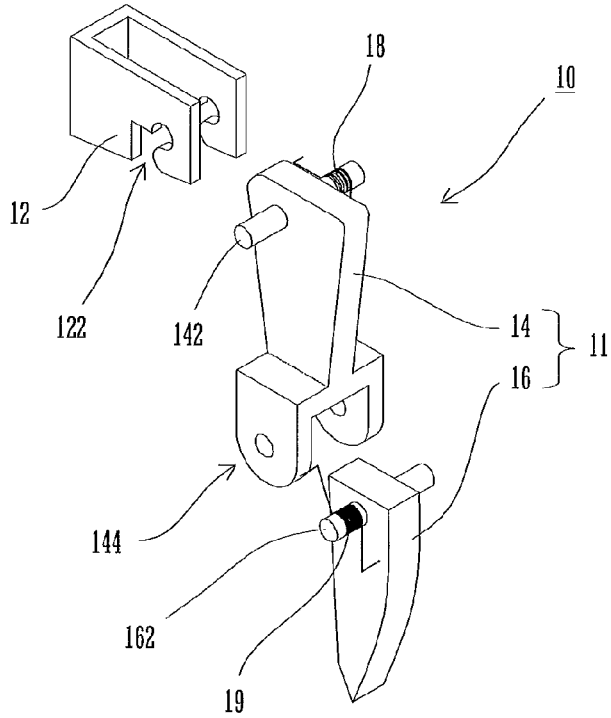
FIG. 3A is a perspective view illustrating an exemplary configuration of the sheet separation mechanism.
Figure 3B:
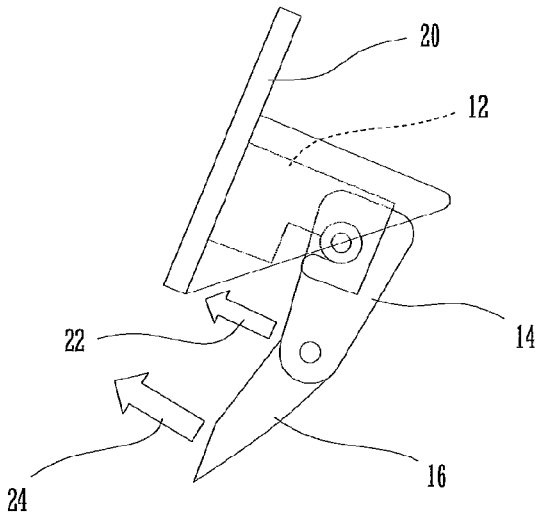
FIG. 3B is a side view illustrating an exemplary configuration of the sheet separation mechanism.

As illustrated in FIG. 3A and FIG. 3B, the sheet separation mechanism 10 includes a separation claw holder 12, a separation claw 11, a first coil spring 18 and a second coil spring 19.

The separation claw holder 12 is configured to be attachable at a predetermined place in the image forming apparatus 50. In the present embodiment, the separation claw holder 12 is attached to an internal frame 20 in the image forming apparatus 50 via a fixture such as a screw. The separation claw holder 12 is provided with a shaft bearing 122 pivotally supporting the separation claw 11.

The separation claw 11 includes a separation claw base 14 pivotally supported by the separation claw holder 12 and a separation claw front-end 16 pivotally supported by the separation claw base 14. The separation claw base 14 includes a shaft 142 pivotally supported by the shaft bearing 122 of the separation claw holder 12 and a shaft bearing 144 pivotally supporting the separation claw front-end 16. The separation claw front-end 16 includes a shaft 162 pivotally supported by the shaft bearing 144 of the separation claw base 14.

The first coil spring 18 is disposed to intervene between the separation claw holder 12 and the separation claw base 14. This first coil spring 18 is configured to apply a force to rotate the separation claw base 14 toward the intermediate transfer belt 94 (see arrow 22 in FIG. 3B).

The second coil spring 19 is disposed to intervene between the separation claw base 14 and the separation claw front-end 16. This second coil spring 19 is configured to apply a force to rotate the separation claw front-end 16 toward the intermediate transfer belt 94 (see arrow 24 in FIG. 3B). Herein, the sheet separation mechanism 10 includes a rotation range limiting member (e.g., a positioning stopper) to limit the rotation range of the separation claw base 14 and the separation claw front-end 16.

Figure 4:
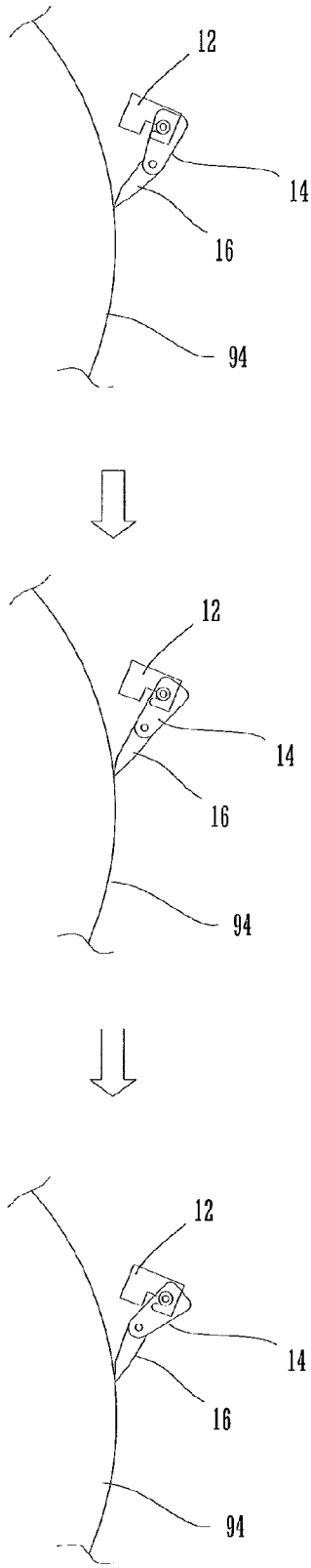
FIG. 4 illustrates an operation of the sheet separation mechanism.

In this configuration, the separation claw base 14 and the separation claw front-end 16 are jointed at a center portion of the separation claw 11 so that they can rotate around a jointed pivot. That is, the separation claw 11 itself is configured to bend between the separation claw base 14 and the separation claw front-end 16. When a sheet causing a conveyance jam applies a force to press the separation claw 11, the separation claw 11 bends as illustrated in FIG. 4. This bending absorbs the force from the sheet. As a result, a trouble such as a damage of the circumferential face of the intermediate transfer belt 94 caused by the sharp tip of the separation claw front-end 16 engaged therein can be prevented appropriately.

Even when the separation claw 11 bends, the tip of the separation claw 11 is kept to come into contact with the intermediate transfer belt 94, and therefore a trouble of the intermediate transfer belt 94 entangling a sheet during multi-sheet feeding can be appropriately prevented without impairing the original function of the separation claw 11.

Preferably, in this configuration, a biasing force of the second coil spring 19 (see the arrow 24 of FIG. 3B) is larger than a biasing force of the first coil spring 18 (see the arrow 22 of FIG. 3B). This configuration is preferable because the tip of the separation claw 11 can easily and more appropriately come into contact with the circumferential face of the rotating body, and even when the separation claw bends by a force applied from a sheet causing a conveyance jam, the separation claw 11 can easily return to the original state after removal of the sheet.

In this way, according to the above-stated present embodiment, the separation claw 11 always comes into contact with the intermediate transfer belt 94 in a state where the intermediate transfer belt 94 is less prone to receive a damage, i.e., in a state where the sharp end of the separation claw is not pressed against the intermediate transfer belt 94. Therefore, the present embodiment can prevent the circumferential face of the intermediate transfer belt 94 from being damaged by the tip end of the separation claw 11 appropriately without impairing the original function of the separation claw 11.

The present embodiment has described an example of the sheet separation mechanism 10 coming into contact with the circumferential face of the intermediate transfer belt 94. Instead, the sheet separation mechanism 10 may be disposed to come into contact with the circumferential face of the photoreceptor drum 90, the heat roller 72 or the pressure roller 76.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. A sheet separation mechanism disposed so as to be opposed to a circumferential face of a rotating body disposed along a sheet conveyance path in an image forming apparatus, comprising:

a separation claw holder that can be provided at a predetermined place in the image forming apparatus;

a separation claw including a separation claw base pivotally supported by the separation claw holder and a separation claw front-end pivotally supported by the separation claw base;

first biasing member disposed between the separation claw holder and the separation claw base, the first biasing member being configured to apply a force to rotate the separation claw base toward the rotating body; and second biasing member disposed between the separation claw base and the separation claw front-end, the second biasing member being configured to apply a force to rotate the separation claw front-end toward the rotating body wherein a biasing force of the second biasing member is larger than a biasing force of the first biasing member.

2. An image forming apparatus comprising the sheet separation mechanism according to claim 1.

* * * * *